US009590322B2

(12) United States Patent
Iwahori et al.

(10) Patent No.: US 9,590,322 B2
(45) Date of Patent: Mar. 7, 2017

(54) CONNECTOR

(71) Applicant: YAZAKI CORPORATION, Tokyo (JP)

(72) Inventors: Yoshihiro Iwahori, Shizuoka (JP); Keiji Hamada, Tochigi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/782,328

(22) PCT Filed: Mar. 28, 2014

(86) PCT No.: PCT/JP2014/059375
§ 371 (c)(1),
(2) Date: Oct. 5, 2015

(87) PCT Pub. No.: WO2014/163025
PCT Pub. Date: Oct. 9, 2014

(65) Prior Publication Data

US 2016/0104950 A1 Apr. 14, 2016

(30) Foreign Application Priority Data

Apr. 5, 2013 (JP) ..... 2013-079792

(51) Int. Cl.
*H01R 4/24* (2006.01)
*H01R 12/77* (2011.01)
(Continued)

(52) U.S. Cl.
CPC ..... *H01R 4/2404* (2013.01); *H01R 12/775* (2013.01); *H01R 4/2433* (2013.01);
(Continued)

(58) Field of Classification Search
CPC ..... H01R 4/2404; H01R 12/775; H01R 12/67
See application file for complete search history.

(56) References Cited

U.S. PATENT DOCUMENTS 4,463,998 A * 8/1984 Reavis ..... H01R 23/66 439/137
4,973,264 A * 11/1990 Kamono ..... H01R 12/777 29/879
(Continued)

FOREIGN PATENT DOCUMENTS

JP 04-079112 B2 12/1992
JP 11-016630 A 1/1999
(Continued)

OTHER PUBLICATIONS

International Preliminary Report on Patentability and English language Written Opinion of the International Search Report for PCT/JP2014/059375.
(Continued)

*Primary Examiner* — Briggitte R Hammond
(74) *Attorney, Agent, or Firm* — Kenealy Vaidya LLP

(57) ABSTRACT

A connector housing, terminals which have press-connecting blades that are exposed from the back end surface of the connector housing, a bus bar plate which is mounted to the back end surface of the connector housing, and a cover which is mounted by a pressing force which makes the press-connecting blades that penetrate insulators to be press-connected to signal lines of a shield attached flat cable, and makes a shield member contact the bus bar, and which holds and fixes an electric wire sheath attached part between the cover and the connector housing are included.

7 Claims, 14 Drawing Sheets

(51) Int. Cl.
*H01R 12/59* (2011.01)
*H01R 12/67* (2011.01)
*H01R 12/79* (2011.01)

(52) U.S. Cl.
CPC ..... *H01R 12/594* (2013.01); *H01R 12/675* (2013.01); *H01R 12/79* (2013.01)

(56) References Cited

U.S. PATENT DOCUMENTS 5,174,782 A * 12/1992 Bogiel ..... H01R 23/667 439/404
5,882,227 A * 3/1999 Neidich ..... H01R 12/7005 439/372
5,902,147 A * 5/1999 Jochen ..... H01R 12/675 439/405
5,967,832 A * 10/1999 Ploehn ..... H01R 23/662 439/497
6,019,627 A * 2/2000 Embo ..... H01R 4/2433 439/405

FOREIGN PATENT DOCUMENTS

JP 2004349127 A 12/2004
JP 2008004464 A 1/2008

OTHER PUBLICATIONS

International Search Report for PCT/JP2014/059375 dated Mar. 28, 2014 with partial English translation.
Office Action issued Jul. 26, 2016 to Japanese Patent Application No. 2013-079792 (with English Translation).

* cited by examiner

CONNECTOR

TECHNICAL FIELD

The present invention relates to a connector which is connected to a shield attached flat cable in which the peripheries of signal lines are covered with insulators and the outsides of the insulators are covered with a shield member.

BACKGROUND ART

A shield attached flat cable is known in which the peripheries of signal lines are covered with insulators and the outsides of the insulators are covered with a shield member (refer to PTL 1). When the connector is attached to an end of the shield attached flat cable, it is necessary to connect signal terminals of the connector to the signal lines of the shield attached flat cable, and to connect a connector side grounding member (a grounded member such as a grounding terminal or a shield shell) to the shield member.

CITATION LIST

Patent Literature

PTL 1: JP-A-2008-004464

SUMMARY OF INVENTION

Technical Problem

Traditionally, when the shield member of the shield attached flat cable is connected to the shield shell which is a connector side grounding member, because it is necessary to connect the shield member to the shield shell in addition to connecting the signal lines of the shield attached flat cable and the signal terminals of the connector, there is a problem that it takes a lot of man-hours for connection. For example, when the shield member of the shield attached flat cable is connected to the connector side grounding terminal, as described in the patent document 1, it is necessary to ensure that one of the conductors of the shield attached flat cable is a drain line (GND line), and to keep that the shield member is electrically connected to the drain line beforehand, there is a problem that the constitution becomes complicated.

The present invention is made in view of the above circumstances, and the object of the present invention is to provide a connector for which the connection of the signal lines of the shield attached flat cable and the connection of the shield member can be easily performed.

Solution to Problem

To achieve the previously described object, the connector according to the present invention is characterized by the following (1) to (5).

(1) A connector, which is connected to a shield attached flat cable in which peripheries of signal lines are covered by insulators, outsides of the insulators are covered by a shield member and an outside of the shield member is covered by an electric wire sheath, includes:

a connector housing;

terminals that are accommodated in the connector housing so that press-connecting blades are exposed from a back end surface of the connector housing;

a bus bar that is mounted to the back end surface of the connector housing, and is connected to a grounding circuit; and a cover that, while the shield attached flat cable, the press-connecting blades of the terminals and the bus bar are intervened between the back end surface of the connector housing and the cover, is mounted to the connector housing to cover the back end surface of the connector housing by a pressing force which makes the press-connecting blades that penetrate the insulators to be press-connected to the signal lines of the shield attached flat cable and makes the shield member that is exposed from the shield attached flat cable contact the bus bar, wherein the cover is provided with a cable fixing portion that holds and fixes the shield attached flat cable.

(2) In the connector according to the above (1), the cover is provided with a cable holding portion, as the cable fixing portion, which holds and fixes an electric wire sheath attached part of the shield attached flat cable between the connector housing and the cover when the cover is mounted to the connector housing.

(3) In the connector according to the above (1), the cover is provided with a cable holding portion, as the cable fixing portion, which makes the shield member which is exposed from the shield attached flat cable press and contact the bus bar, and at the same time holds and fixes the shield attached flat cable between the bus bar and the cover, when the cover is mounted to the connector housing.

(4) In the connector according to the above (1), the cover has a first cover body which, while the shield attached flat cable, the press-connecting blades of the terminals and the bus bar are intervened between the back end surface of the connector housing and the cover, is mounted to the connector housing to cover the back end surface of the connector housing by a pressing force which makes the press-connecting blades that penetrate the insulators to be press-connected to the signal lines of the shield attached flat cable and makes the shield member that is exposed from the shield attached flat cable contact the bus bar, and a second cover body which is mounted to the first cover body, and is provided with a cable holding portion, as the cable fixing portion, between the first cover body and the second cover body, which holds and fixes an electric wire sheath attached part of the shield attached flat cable between the first cover body and the second cover body when the first cover body is mounted to the second cover body.

(5) In the connector according to the above (4), the cover is provided with a hinge portion which couples the first cover body with the second cover body.

According to the connector of the constitution of the above (1), only by performing one operation of mounting the cover to the connector housing, the connection of the terminals and the signal lines, and the connection of the bus bar and the shield member can be collectively performed at the same time. Therefore, the man-hours of the connecting operation of the connector and the shield attached flat cable can be significantly reduced. Further, when the cover is mounted, the shield member contacts the bus bar plate (equivalent to a grounding member) that is mounted to the back end surface of the connector housing. Thus, it is only required to keep the shield member of the shield attached flat cable exposed before the cover is mounted, and the constitution can be simplified. It is possible to exert a fixing force to the shield attached flat cable at a part where the shield member contacts the bus bar, and apart from the above part, it is also possible that the shield attached flat cable is held and fixed by the cable fixing portion which the cover is provided with. Thus, a useless external force can be prevented as much as possible from being exerted to the press-connecting part of the flat cable and the terminals.

According to the connector of the constitution of the above (2), because the cable holding portion which the cover is provided with holds and fixes the electric wire sheath attached part of the shield attached flat cable between the connector housing and the cover when the cover is mounted to the connector housing, the shield attached flat cable can be strongly held and fixed while the cover is mounted. Thus, a useless external force can be prevented from being exerted to the press-connecting part.

According to the connector of the constitution of the above (3), because the part that makes the shield member press and contact the bus bar becomes the cable holding portion, by mounting the cover to the connector housing, while the shield member is made to press and contact the bus bar, the shield attached flat cable can be held and fixed between the cover and the bus bar. Thus, a useless external force can be prevented from being exerted to the press-connecting part.

According to the connector of the constitution of the above (4), by mounting the first cover body to the connector housing, the connection of the terminals and the signal lines, and the connection of the bus bar and the shield member can be collectively performed at the same time. Moreover, by mounting the second cover body to the first cover body, the shield attached flat cable can be held and fixed by the cable holding portion. Thus, a useless external force can be prevented from being exerted to the press-connecting part.

According to the connector of the constitution of the above (5), because the first cover body and the second cover body are coupled through the hinge portion, the first cover body and the second cover body can be molded as one component, and can be handled as one component.

To achieve the previously described object, a connecting structure of the connector and the shield attached flat cable according to the present invention is characterized by the following (6).

(6) A connecting structure of connecting the connector of the above (1) to a shield attached flat cable, wherein only a half body, at the side where the bus bar and a shield member contact in the thickness direction of the shield attached flat cable, of an electric wire sheath of the shield attached flat cable is removed, the other half body at the opposite side remains until the positions where the press-connecting blades press-connect, besides, the shield member at the positions where the press-connecting blades press-connect is removed, the shield member is exposed at a part which contacts the bus bar, while the shield attached flat cable, the press-connecting blades of the terminals and the bus bar are intervened between the back end surface of the connector housing and the cover, the cover is mounted to the connector housing to cover the back end surface of the connector housing by a pressing force which makes the press-connecting blades penetrate the insulators and the half body of the electric wire sheath of the shield attached flat cable to be press-connected to the signal lines and makes the shield member that is exposed from the shield attached flat cable contact the bus bar, and in this state, the shield attached flat cable is held and fixed by a cable fixing portion which the cover is provided with.

According to the connecting structure of the connector and the shield attached flat cable of the constitution of the above (6), because the connector of the constitution of the above (1) is used, the same effects as that of the connector can be obtained. Particularly, because the other half body of the electric wire sheath at the part where the press-connecting blades press-connect the signal lines remains, the press-connecting blades penetrate the insulators and the electric wire sheath at the same time, and the combination of the press-connecting blades and the shield attached flat cable becomes strong.

According to the present invention, only by performing one operation of mounting the cover to the connector housing, the connection of the terminals and the signal lines, and the connection of the bus bar and the shield member can be collectively performed at the same time. Therefore, the man-hours of the connecting operation of the connector and the shield attached flat cable can be significantly reduced, and the assembling efficiency can be increased. Further, because the shield member only has to be exposed for the connection with the grounding member which is the bus bar, the constitution for the grounding connection does not become complicated. Further, because the shield attached flat cable can be held and fixed by the cable fixing portion which the cover is provided with, an external force can be prevented from being exerted to the press-connecting part.

The present invention has been briefly described above. Further, details of the invention will become more apparent after embodiments of the invention described below (hereinafter referred to as "embodiments") are read with reference to the accompanying figures.

BRIEF DESCRIPTION OF DRAWINGS

FIGS. 4A to 4C are perspective views which show the constitution of an end processed portion of a shield attached flat cable that is used for the connector of the first embodiment of the present invention, in which FIG. 4A is an appearance view, FIG. 4B is an enlarged view of a part of the end processed portion, and FIG. 4C is a figure watched from above.

FIGS. 13A to 13C are perspective views which show the constitution of an end processed portion of a shield attached flat cable that is used for the connector of the second embodiment of the present invention, in which FIG. 13A is an appearance view, FIG. 13B is an enlarged view of a part of the end processed portion, and FIG. 13C is a figure watched from above.

DETAILED DESCRIPTION OF EMBODIMENTS

Below, the embodiments of the invention are described with reference to the figures.

First Embodiment

Figure 1:
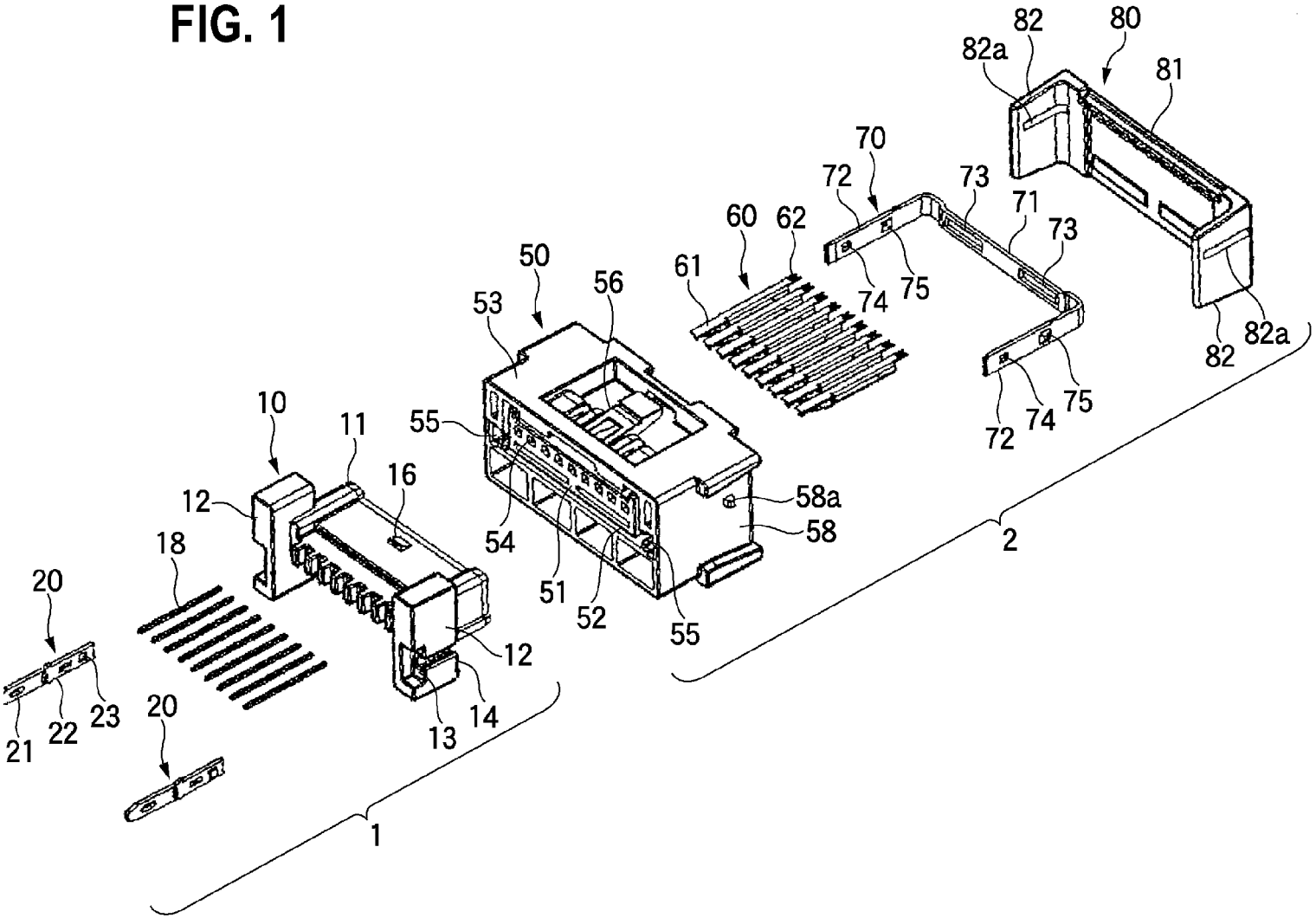
FIG. 1 is an exploded perspective view of a connector device which includes a connector of a first embodiment of the present invention.
Figure 2:
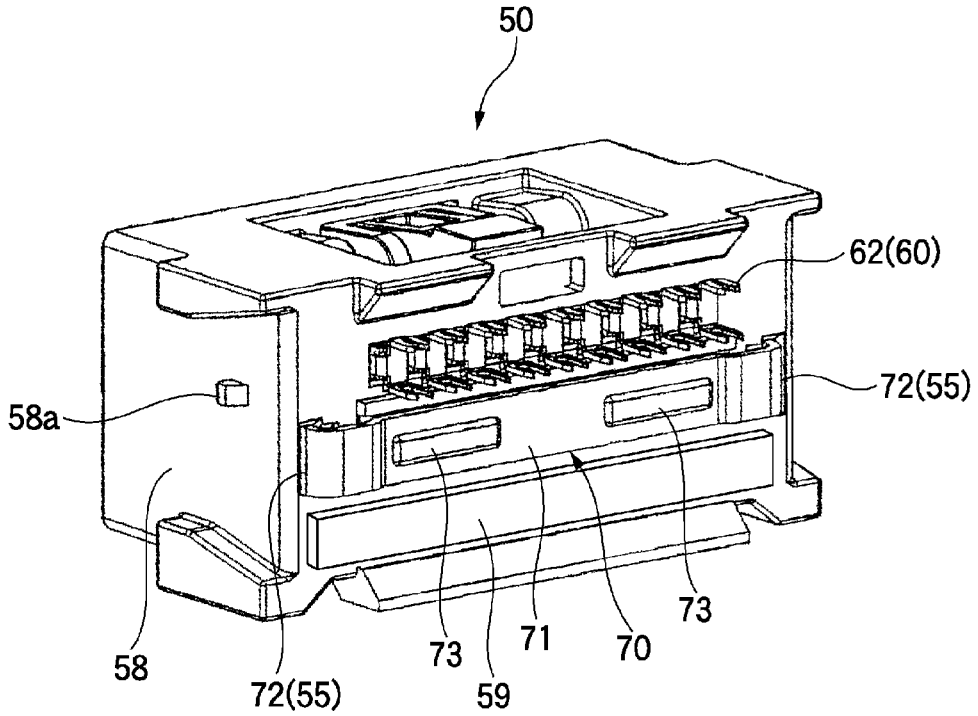
FIG. 2 is a perspective view which shows that a bus bar and terminals are assembled to a connector housing of the connector of the first embodiment of the present invention, when watched from the back side.
Figure 3:
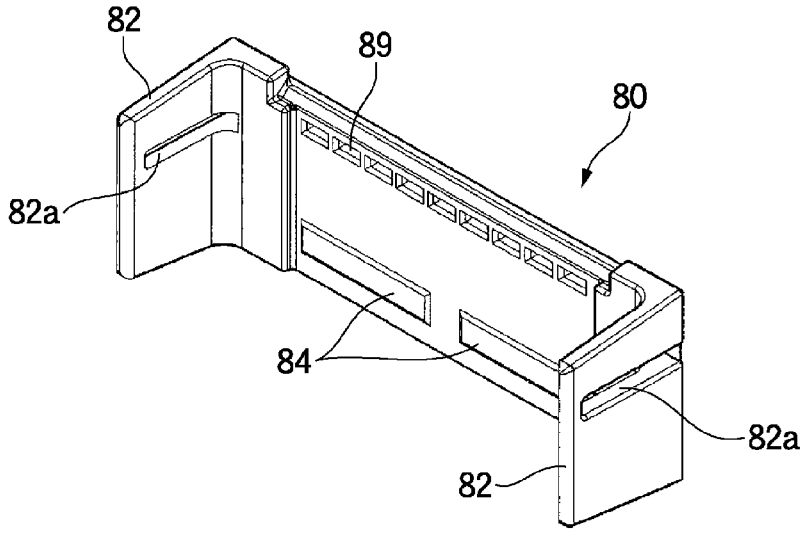
FIG. 3 is a perspective view of a cover which is a component of the connector of the first embodiment of the present invention.
Figure 4A:
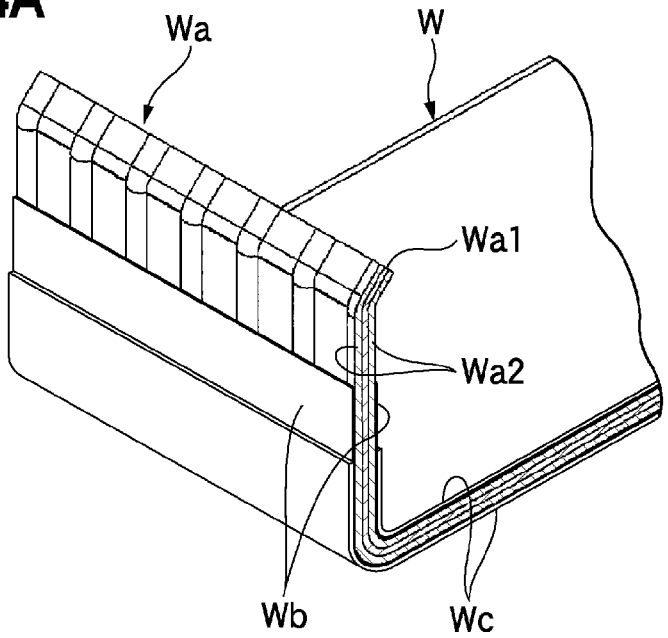
Figure 4B:
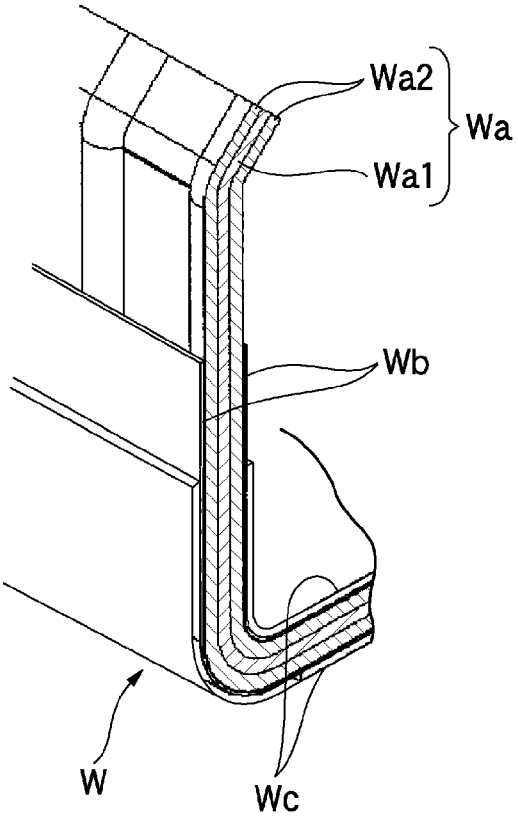
Figure 4C:
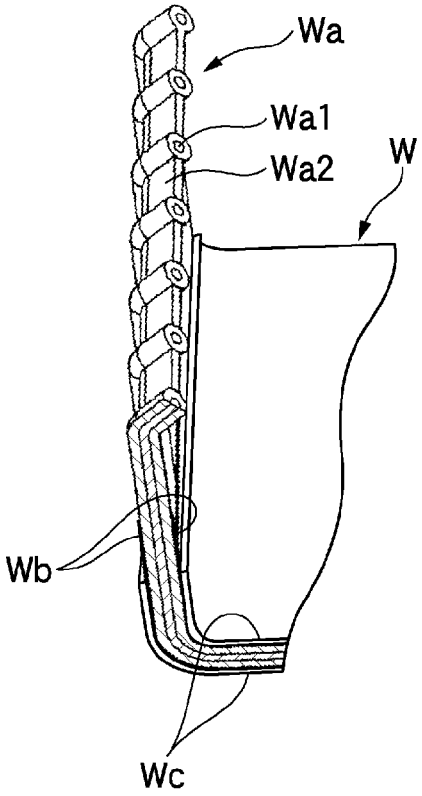
Figure 5:
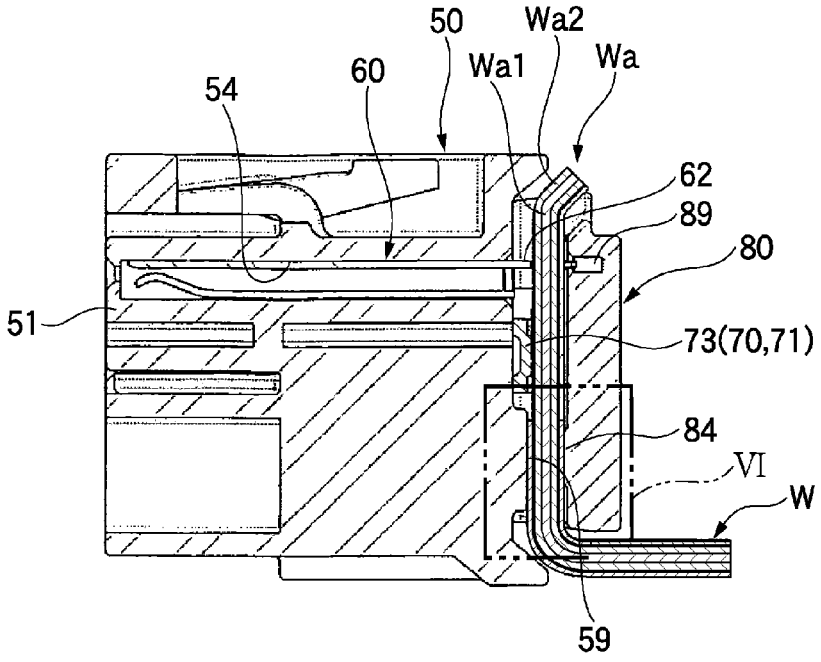
FIG. 5 is a sectional view which shows that the cover is mounted to the back end surface of the connector housing of the connector of the first embodiment of the present invention shown in FIG. 2 and the connector is completed.
Figure 6:
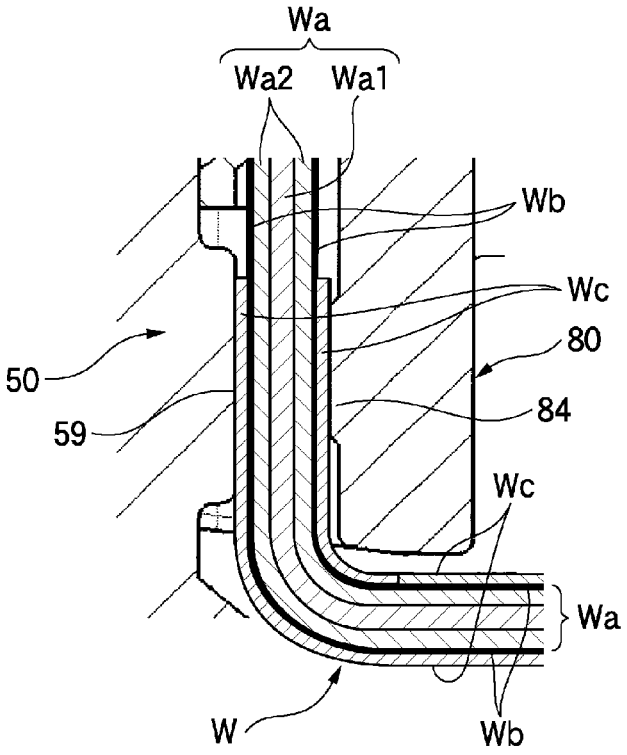
FIG. 6 is an enlarged view of the VI part of FIG. 5.
Figure 7:
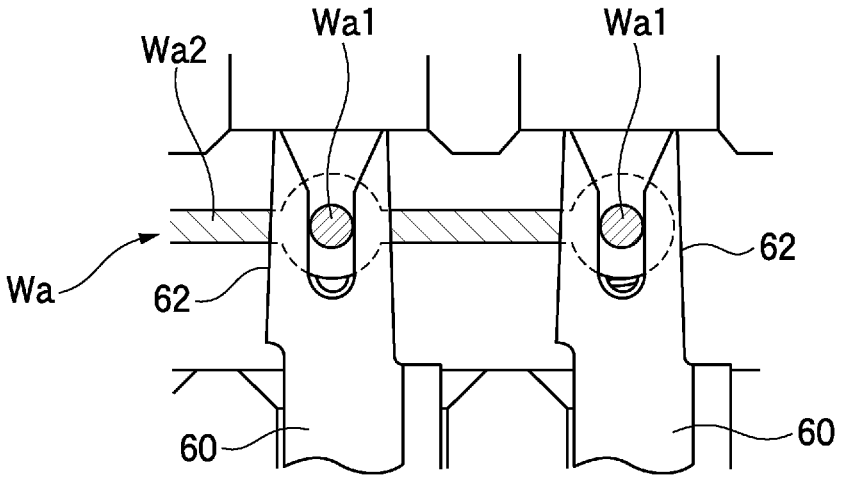
FIG. 7 is a partly enlarged view which shows that press-connecting blades at the back ends of the terminals are press-connected to a flat cable body which is exposed by removing an electric wire sheath and a shield member, and is a figure which shows that the press-connecting blades penetrate insulators and contact conductors which are signal lines.
Figure 8:
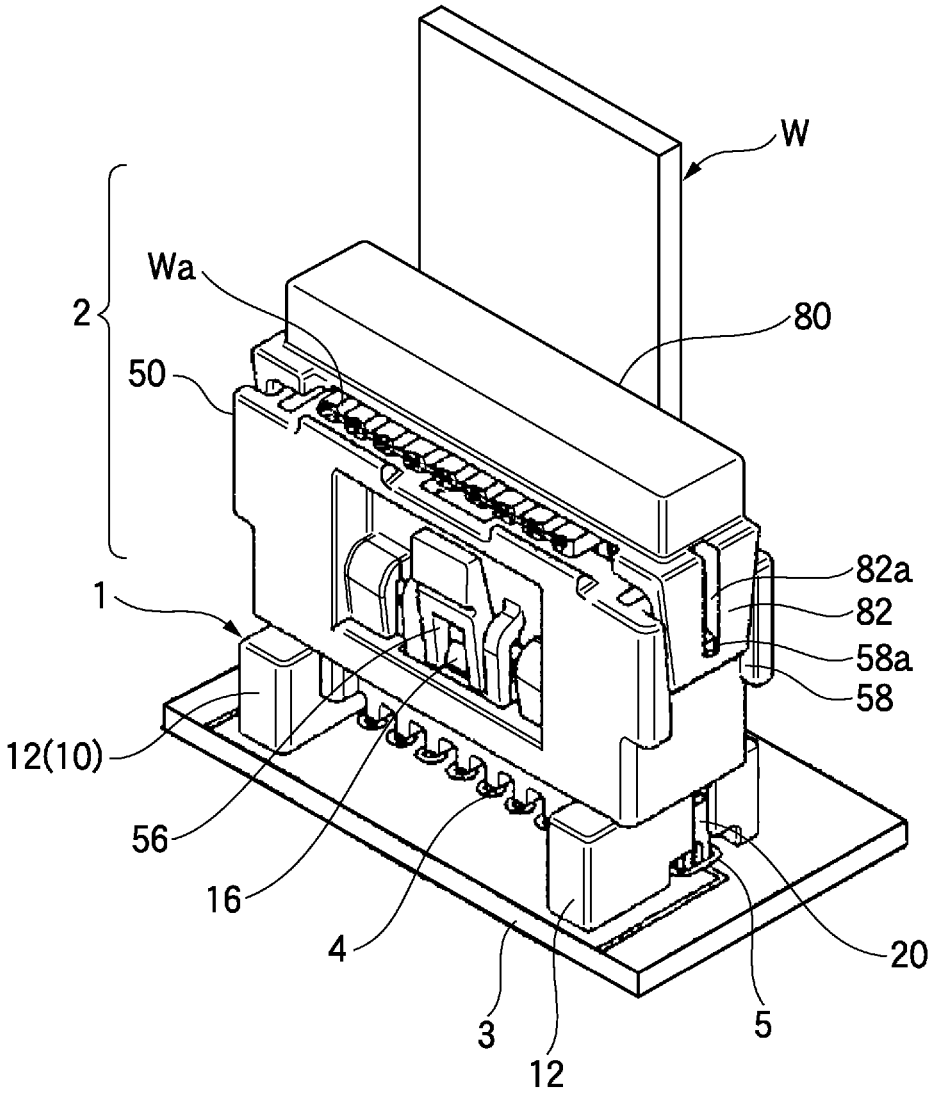
FIG. 8 is an appearance perspective view which shows that the connector of the first embodiment of the present invention is connected to a board side connector at a connection mating side.
Figure 9:
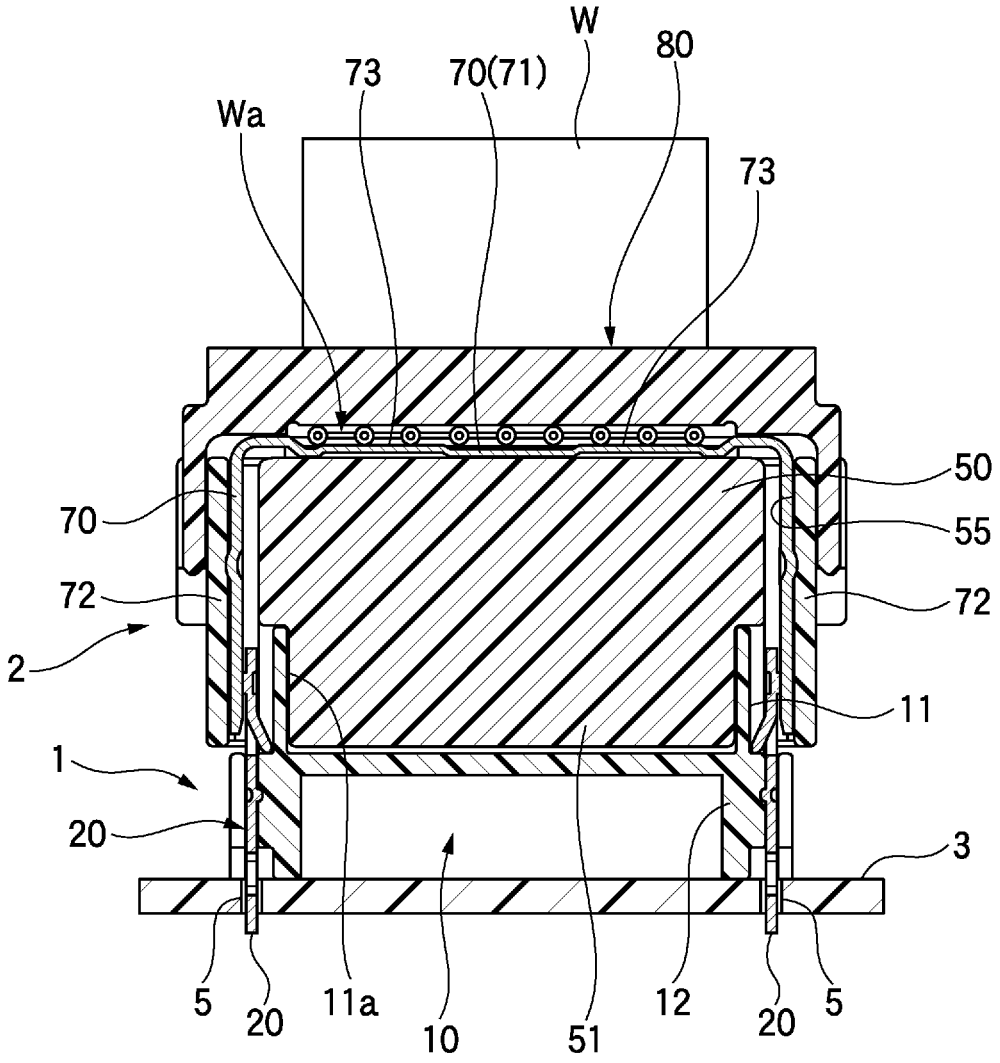
FIG. 9 is a vertical sectional view which shows the state of FIG. 8.

FIGS. 1 to 9 are illustrative figures of the first embodiment. FIG. 1 is an exploded perspective view of a connector device which includes a connector of the first embodiment. FIG. 2 is a perspective view which shows that a bus bar and terminals are assembled to a connector housing of the first embodiment, when watched from the back side. FIG. 3 is a perspective view of a cover which is a component of the connector. FIGS. 4A to 4C are perspective views which show the constitution of an end processed portion of a shield attached flat cable that is used for the connector, in which FIG. 4A is an appearance view, FIG. 4B is an enlarged view of a part of the end processed portion, and FIG. 4C is a figure watched from above. FIG. 5 is a sectional view which shows that the cover is mounted to the back end surface of the connector housing shown in FIG. 2 and the connector is completed. FIG. 6 is an enlarged view of the VI part of FIG. 5. FIG. 7 is a partly enlarged view which shows that press-connecting blades at the back ends of the terminals are press-connected to a flat cable body which is exposed by removing an electric wire sheath and a shield member, and is a figure which shows that the press-connecting blades penetrate insulators and contact signal conductors (signal lines). FIG. 8 is an appearance perspective view which shows that the connector of the first embodiment is connected to a board side connector at a connection mating side. FIG. 9 is a vertical sectional view which shows the state of FIG. 8.

The connector device shown in FIG. 1 includes a board side connector (receptacle) 1 and a cable side connector 2 of the first embodiment which engage with each other. The board side connector 1 is fixed to a circuit board 3, and the cable side connector 2 is attached to an end of a shield attached flat cable W. By using the connector device, the shield attached flat cable W can be electrically connected to the circuit board 3.

The board side connector 1 includes a male housing 10 made of resin, a plurality of male terminals 18 which are press-fitted into the male housing 10, and a pair of pegs 20 made of metal plates which are press-fitted and fixed to the male housing 10 to fix the male housing 10 to the circuit board 3. As shown in FIG. 9, by being inserted into peg through holes 5 of the circuit board 3 and fixed by soldering, the pegs 20 fix the board side connector 1 to the circuit board 3, and are connected to a grounding circuit of the circuit board 3 at the same time.

The male housing 10 has a housing body 11 which includes an engaging hole 11*a* (refer to FIG. 9) into which a female housing 50 of the cable side connector 2 is engaged, and a pair of (right and left) fixing block portions 12 which are integrated at the back end (lower end) side of the housing body 11. When the male terminal 18 is press-fitted into the housing body 11, one end side of the male terminal 18 projects into the engaging hole 11*a*, and the other end side of the male terminal 18 projects backward (downward) beyond the back ends (lower ends) of the fixing block portions 12 (not illustrated). As shown in FIG. 1, a locking projection 16 to lock a locking arm 56 of the female housing 50 when the housing body 11 engages with the female housing 50 of the cable side connector 2 is provided on the outside surface of the housing body 11.

Herein, a front side (upper side) is defined as a side to engage with the cable side connector 2 which is a mating side connector, or a side which is an upper side when the board side connector 1 is fixed to the circuit board 3. Further, a back side (lower side) is defined as a side opposite to the engaging side to engage with the cable side connector 2 which is a mating side connector, or a side which is a lower side when the board side connector 1 is fixed to the circuit board 3.

Peg attaching slots 13 which extend in the forward/backward direction (upward/downward direction) are formed on the outside surfaces of the right and left fixing block portions 12. The pegs 20 are press-fitted from distal end sides to the peg attaching slots 13 from the front side (upper side) to the back side (lower side).

As shown in FIG. 9, the distal end sides of the pegs 20 are parts which are inserted into the peg through holes 5 of the circuit board 3. The base end sides of the pegs 20 are parts which remain at the outside (the upper side) without entering the peg attaching slots 13 after press-fitted. The outside surfaces of the base end sides of the pegs 20 are parts which a bus bar plate (bus bar) 70 for grounding which the cable side connector 2 is provided with contacts and electrically connects with when the board side connector 1 engages with the cable side connector 2.

On the other hand, as shown in FIG. 1, the cable side connector 2, as the connector of the first embodiment, includes the female housing (connector housing) 50 made of resin, a plurality of female terminals 60 which are inserted into terminal insertion holes 54 of the female housing 50, the bus bar plate (bus bar) 70 which is mounted to the back portion of the female housing 50, and a cover (also referred to as strain relief) 80 which is mounted to the back portion of the female housing 50 from the back side of the bus bar plate 70. In the following explanation of the cable side connector 2, a front side is defined as a side to engage with the board side connector 1, and a back side is defined as a side opposite to the front side.

As shown in FIGS. 1 and 2, the female housing 50 has an engaging block portion 51 which is fitted inside the engaging hole 11*a* of the housing body 11 of the board side connector 1, and an exterior hood portion 53 which is provided around the engaging block portion 51, and there are insert slots 52, into which the peripheral walls of the housing body 11 of the male housing 10 are inserted, between the engaging block portion 51 and the exterior hood portion 53. The engaging block portion 51 is formed with the terminal insertion holes 54 into which the female terminals 60 are inserted. The exterior hood portion 53 is provided with the locking arm 56 which maintains an engaging state by locking to the locking projection 16 of the male housing 10 when the male housing 10 engages with the female housing 50 appropriately.

The right and left two sides of the female housing 50 are provided with bus bar attaching slots 55 into which right and left side bars 72 of the bus bar plate 70 are press-fitted. Side plate insertion portions 58, where right and left side plates 82 of the cover 80 are inserted, are provided on the outer surfaces of the right and left two sides of the female housing 50. The side plate insertion portions 58 are provided with locking salients 58*a* which lock into locking grooves 82*a* at the sides of the cover 80. As shown in FIG. 2, a holding salient 59 for holding and fixing the shield attached flat cable W is provided below the part, where the bus bar plate 70 is mounted, of the back end surface of the female housing 50.

As shown in FIG. 1, the female terminal 60 has an engaging portion 61 to engage with the male terminal at the front side in the insertion direction relative to the terminal insertion hole 54, and has a Y-shaped press-connecting blade 62 which is press-connected to a flat cable body Wa of the shield attached flat cable W at the back side in the insertion direction relative to the terminal insertion hole 54. As shown in FIG. 2, while accommodated in the terminal insertion holes 54 of the female housing 50, the press-connecting blades 62 are exposed from the back end surface of the female housing 50.

As shown in FIG. 1, the bus bar plate 70 is formed by bending a band plate into a U shape, and has a central bar 71 which is pressed against the back end surface of the female housing 50, and the pair of side bars 72 which extend forward from the right and left two ends of the central bar 71 and are press-fitted from the back side to the bus bar attaching slots 55 of the female housing 50. As shown in FIG. 2, contact salients 73 to improve contact conductivity with a shield member (web, aluminum foil or the like) Wb of the shield attached flat cable W are provided on the back surface of the central bar 71. As shown in FIG. 1, the side bars 72 are provided with pressing salients 74 to improve contact conductivity with the pegs 20 of the board side connector 1, near the front ends of the side bars 72. The side bars 72 are further provided with press-fitting salients 75 which ensure fixing strength of the press-fitting by cutting into the inner walls of the bus bar attaching slots 55 when the side bars 72 are press-fitted into the bus bar attaching slots 55, behind the pressing salients 74. The bus bar plate 70 is connected to a grounding circuit.

The cover 80 is intended to prevent a force from being mainly applied to a press-connecting part where the shield attached flat cable W and the female terminal 60 are press-connected when mounted. As shown in FIGS. 1 and 3, the cover 80 includes a central cover body 81, and the pair of right and left side plates 82 which extend forward from the two right and left sides of the central cover body 81 and are inserted into the side plate insertion portions 58 of the female housing 50 when the cover 80 is mounted to the female housing 50. As a cable fixing portion, cable holding salients 84, which hold and fix an electric wire sheath Wc attached part of the shield attached flat cable W with the female housing 50, when the cover 80 is mounted to the female housing 50, are provided on the inner surface of the cover body 81. Escape holes 89 are provided at positions corresponding to the press-connecting blades 62 so that the cover 80 will not become a trouble for the press-connecting.

The pair of right and left side plates 82 are formed with the locking grooves 82*a* into which the locking salients 58*a* of the female housing 50 are locked when the cover 80 is appropriately mounted to the female housing 50.

As shown in FIGS. 4A to 4C, the shield attached flat cable W, to which the cable side connector 2 is attached, is a bendable flexible flat cable in which the outside of a flat cable body Wa, in which the peripheries of signal lines (signal conductors) Wa1 are covered with insulators Wa2, is covered with a shield member Wb such as a web or an aluminum foil, and the outside of the shield member Wb is covered with the electric wire sheath Wc, and the signal lines Wa1 are aligned parallel to each other at predetermined intervals. By making the press-connecting blades 62 provided at the back ends of the female terminals 60 cut into the positions of the signal lines Wa1 of the flat cable body Wa which are exposed by removing the electric wire sheath Wc and the shield member Wb, the inside signal lines Wa1 and the female terminals 60 can be press-connected.

Next, a way of assembling the board side connector 1 and the cable side connector 2, and a way of using them are described. When the board side connector 1 is assembled, first, the male terminals 18 are press-fitted into the male housing 10, and the pegs 20 are press-fitted into the peg attaching slots 13 of the male housing 10. When the board side connector 1 is fixed to the circuit board 3, as shown in FIGS. 8 and 9, the back end surfaces (lower end surfaces) of the fixing block portions 12 of the male housing 10 are placed on the circuit board 3, the projecting ends of the male terminals 18 are inserted into terminal through holes 4, and the distal end sides of the pegs 20 are inserted into the peg through holes 5. In this state, the board side connector 1 can be fixed to the circuit board 3 by soldering, and at the same time, while the male terminals 18 can be connected to the respective circuits, the pegs 20 can be connected to the grounding circuit.

On the other hand, to assemble the cable side connector 2, first, the female terminals 60 are inserted into and fixed (or press-fitted) to the terminal insertion holes 54 of the female housing 50. The side bars 72 of the bus bar plate 70 are press-fitted into the bus bar attaching slots 55 which the female housing 50 is formed with. At this time, as shown in FIG. 2, the female terminals 60 and the bus bar plate 70 are kept contactless from each other.

Next, an end of the shield attached flat cable W is processed as shown in FIGS. 4A to 4C. When the connector of the first embodiment is used, a suitable length of the electric wire sheath Wc is removed so that a suitable length of the shield member Wb is exposed at the removed part. Further, a suitable length of the shield member Wb is removed so that a suitable length of the flat cable body Wa (the part including the signal lines Wa1 and the insulators Wa2) is exposed at the removed part.

Then, the end processed portion of the shield attached flat cable W is arranged to cover the top of the central bar 71 of the bus bar plate 70 which was previously mounted the back portion of the female housing 50, and as shown in FIGS. 5 and 6, from the back side of the end processed portion of the shield attached flat cable W, the cover 80 is mounted to the back portion of the female housing 50 while a pressing force is applied. The locking salients 58*a* of the female housing 50 are locked into the locking grooves 82*a* of the right and left side plates 82 of the cover 80.

Then, while the end processed portion of the shield attached flat cable W, the press-connecting blades 62 of the female terminals 60 and the bus bar plate 70 are intervened between the back end surface of the female housing 50 and the cover 80, the back end surface of the female housing 50 is covered by the cover 80. As shown in FIG. 7, by a pressing operation when the cover 80 is mounted, the press-connecting blades 62 of the female terminals 60 cut into the positions of the signal lines Wa1 of the flat cable body Wa where the electric wire sheath Wc and the shield member Wb are removed, and the female terminals 60 and the signal lines Wa1 are press-connected. By mounting the cover 80, the shield member Wb exposed from the shield attached flat cable W is pressed to contact the bus bar plate 70.

By mounting the cover 80, as shown in FIG. 6, the electric wire sheath Wc attached part of the shield attached flat cable W, is held and fixed between the cable holding salients 84 which are provided as a cable fixing portion and the holding salient 59 at the back end surface of the female housing 50.

Then, as shown in FIGS. 8 and 9, when the cable side connector 2 constructed in this way is engaged with the board side connector 1, the flat cable can be electrically connected to the circuit board 3. In this case, when the side bars 72 of the bus bar plate 70 of the cable side connector 2 slide to electrically contact the outer side surfaces of the base end side of the pegs 20 of the board side connector 1, the shield member Wb of the shield attached flat cable W can be connected to the grounding circuit of the circuit board 3 through the bus bar plate 70 and the pegs 20.

As described above, according to the cable side connector 2 in this connector device, only by performing one operation of mounting the cover 80 to the female housing 50, the connection of the female terminals 60 and the signal lines Wa1, and the connection of the bus bar plate 70 and the shield member Wb can be collectively performed at the same time. Therefore, the man-hours of the connecting operation of the cable side connector 2 and the shield attached flat cable W can be significantly reduced.

Further, when the cover 80 is mounted, the shield member Wb contacts the bus bar plate (equivalent to a grounding member) 70 that is mounted to the back end surface of the female housing 50. Thus, it is only required to keep the shield member Wb of the shield attached flat cable W exposed before the cover 80 is mounted, and the constitution can be simplified.

It is possible to exert a fixing force to the shield attached flat cable W at a part where the shield member Wb contacts the bus bar plate 70, and apart from the above part, it is also possible that the electric wire sheath Wc attached part of the shield attached flat cable W is held and fixed by the cable fixing portion (cable holding salients 84) which the cover 80 is provided with. Thus, a useless external force can be prevented as much as possible from being exerted to the press-connecting part of the flat cable body Wa and the female terminals 60.

When a cable holding force that is strong enough is provided at the part where the shield member Wb is pressed to contact the bus bar plate 70, the part where the shield member Wb is pressed by the cover 80 is functionalized as a cable holding portion (cable fixing portion), and the cable holding salients 84 can be omitted.

Second Embodiment

Next, the second embodiment of the present invention will be described.

Figure 10:
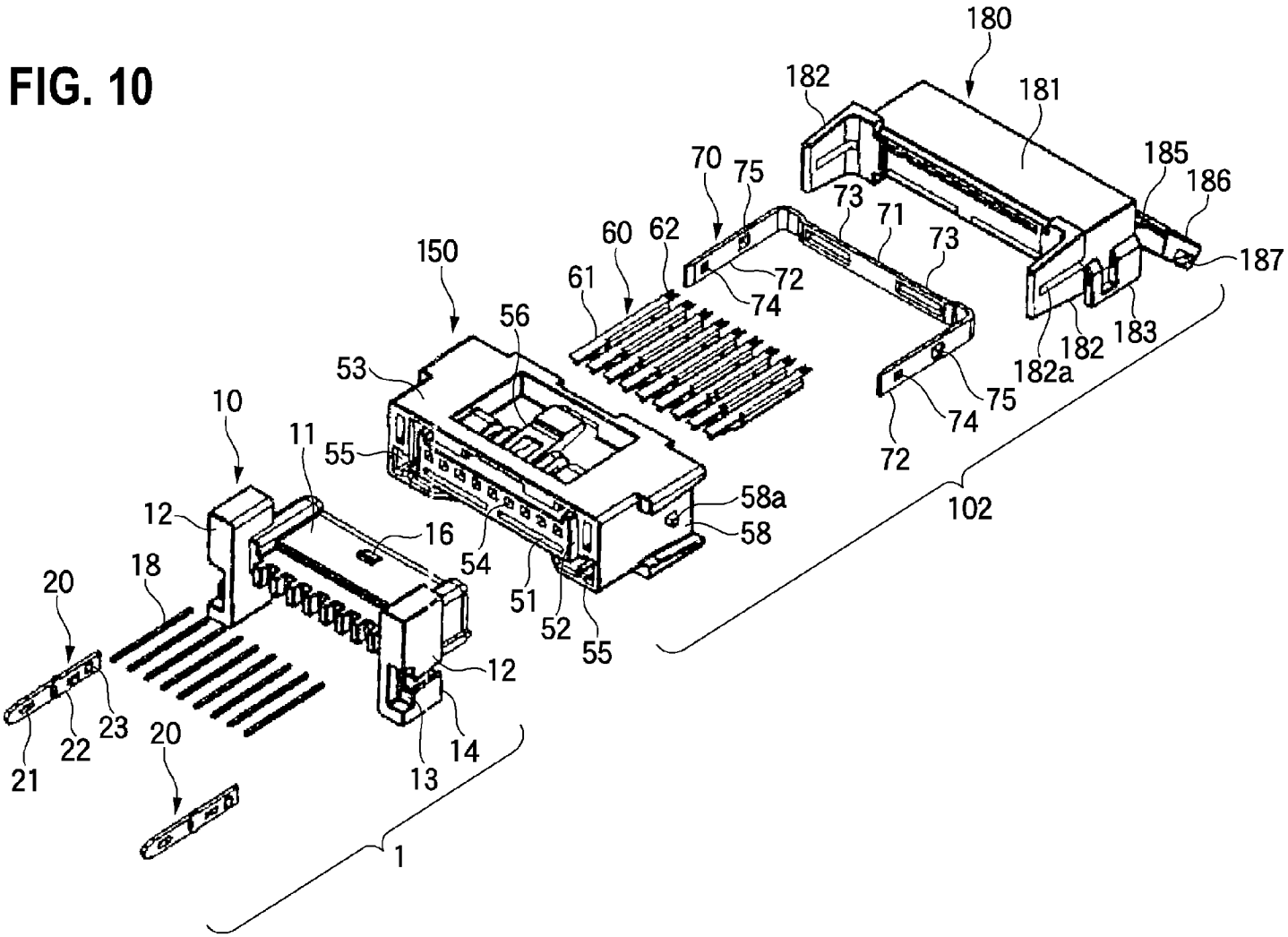
FIG. 10 is an exploded perspective view of a connector device which includes a connector of a second embodiment of the present invention.
Figure 11:
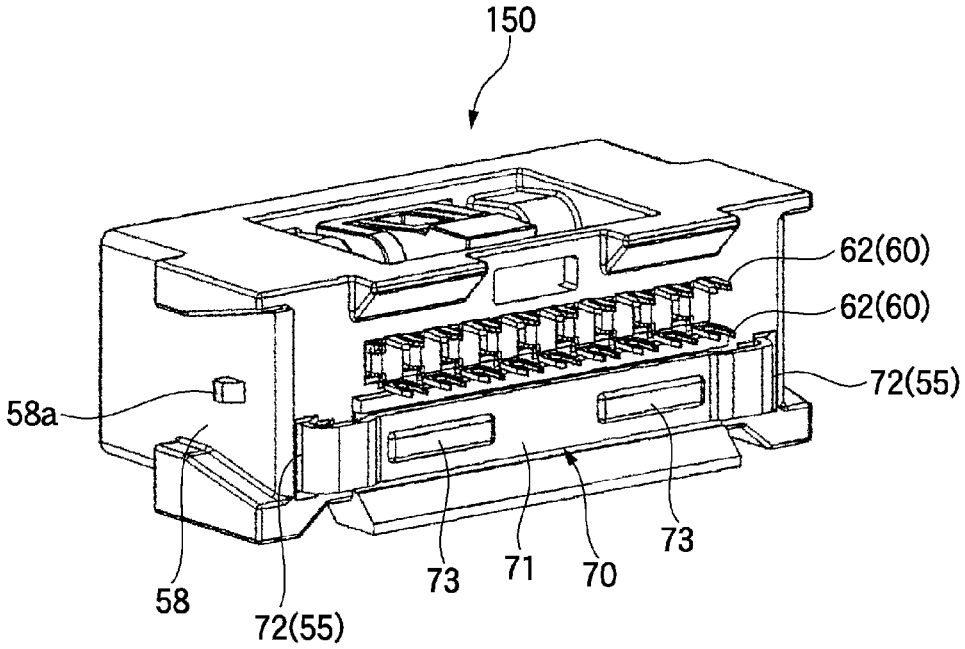
FIG. 11 is a perspective view which shows that a bus bar and terminals are assembled to a connector housing of the connector of the second embodiment of the present invention, when watched from the back side.
Figure 12:
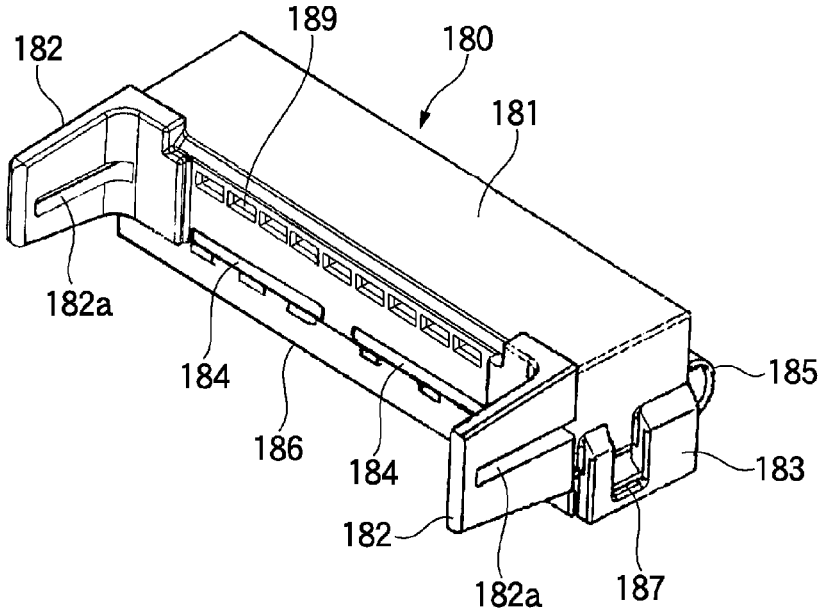
FIG. 12 is a perspective view of a cover which is a component of the connector of the second embodiment of the present invention.
Figure 13A:
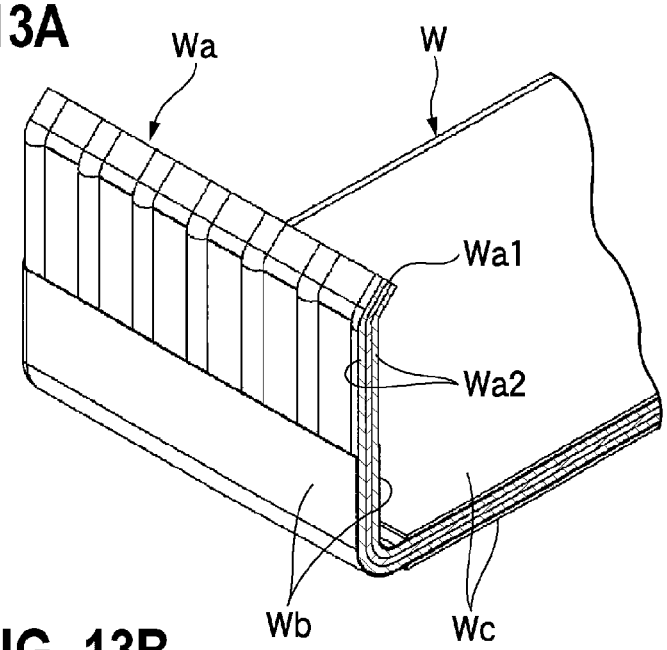
Figure 13B:
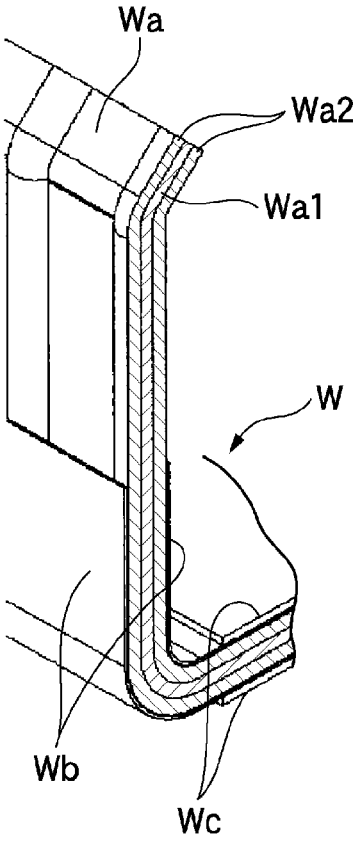
Figure 13C:
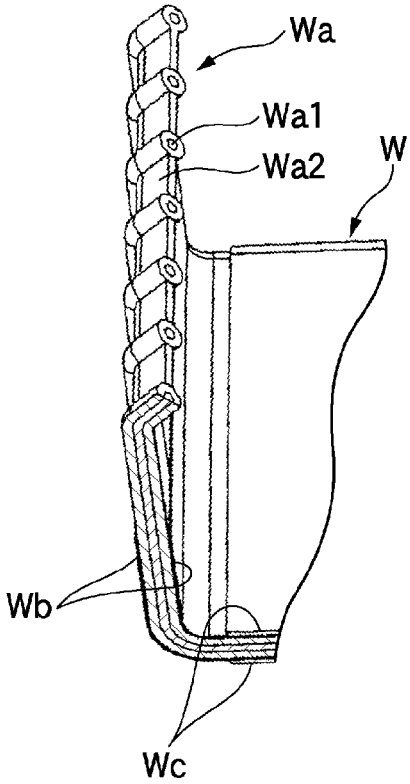
Figure 14:
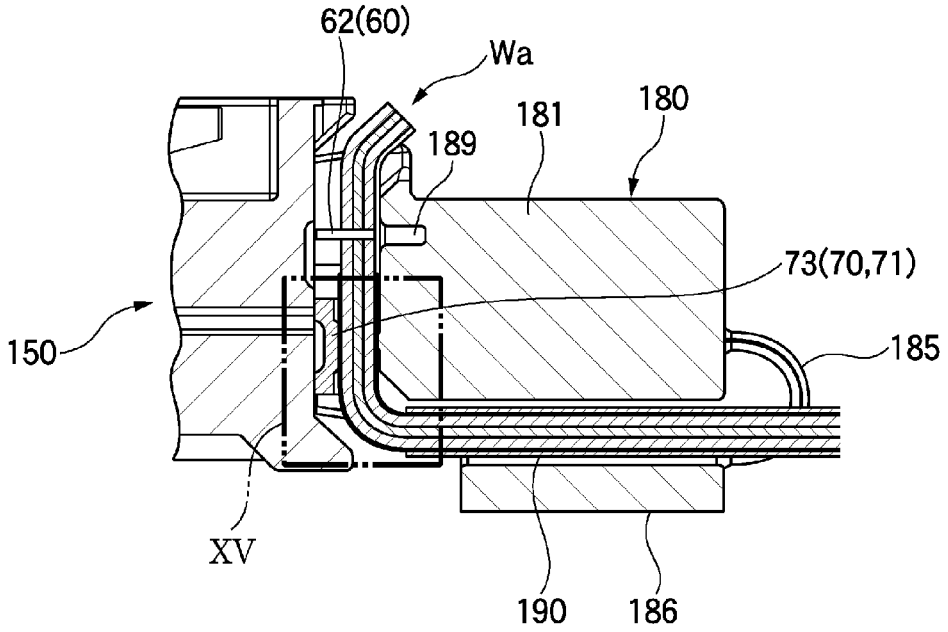
FIG. 14 is a sectional view which shows that the cover is mounted to the back end surface the connector housing of the connector of the second embodiment of shown in FIG. 11 and the connector is completed.
Figure 15:
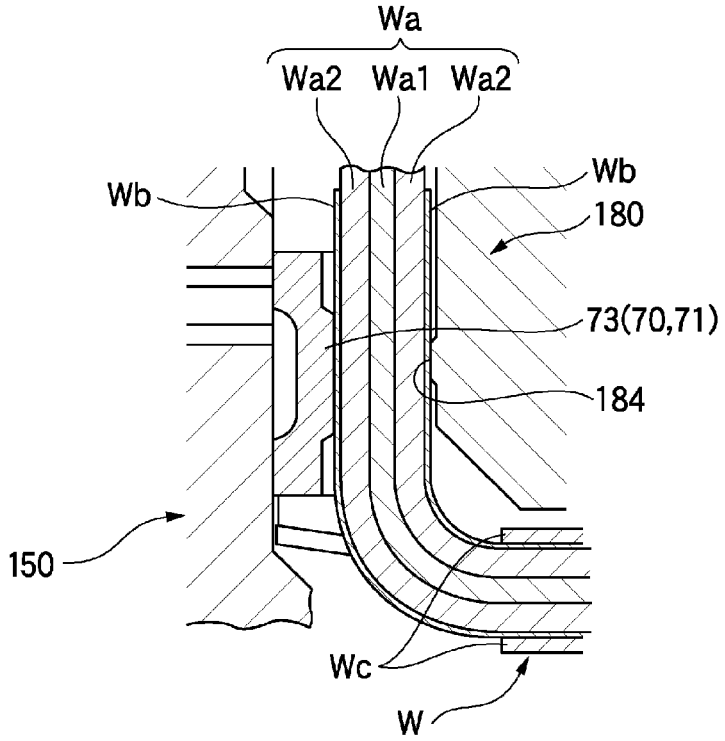
FIG. 15 is an enlarged view of the XV part of FIG. 14.
Figure 16:
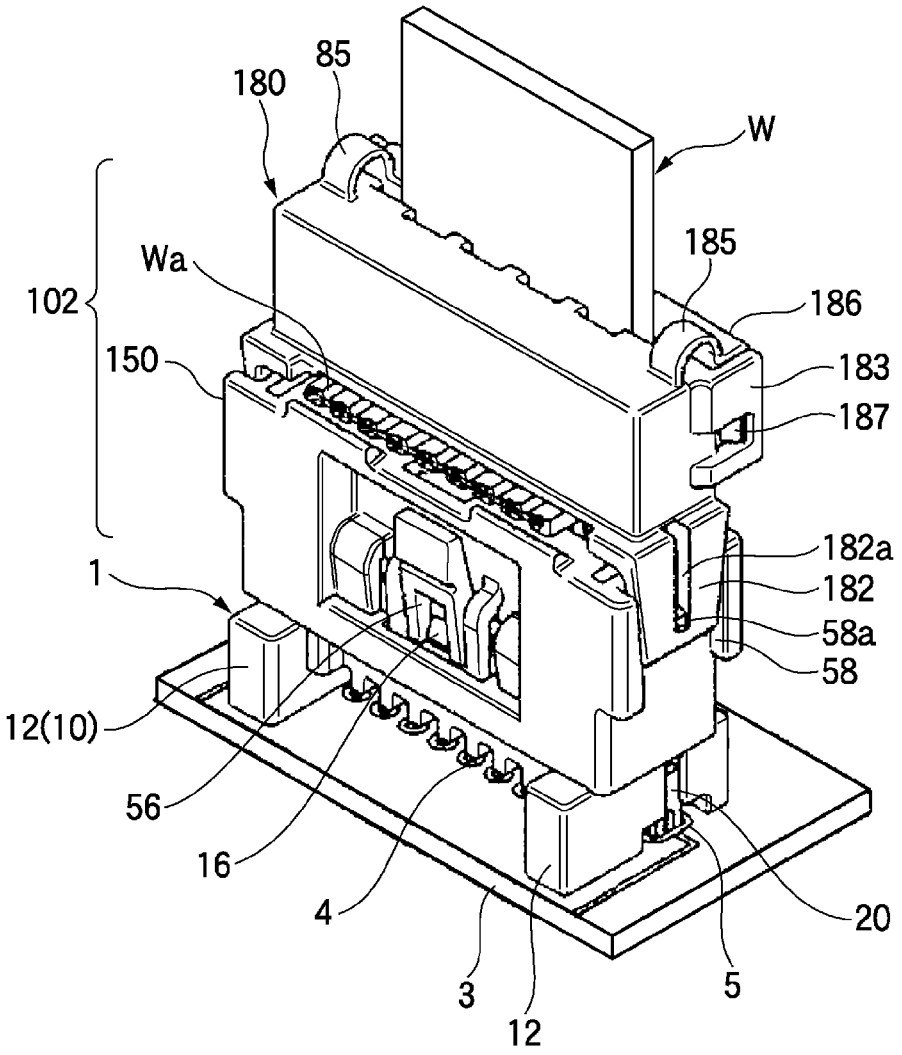
FIG. 16 is an appearance perspective view which shows that the connector of the second embodiment of the present invention is connected to a board side connector at a connection mating side.
Figure 17:
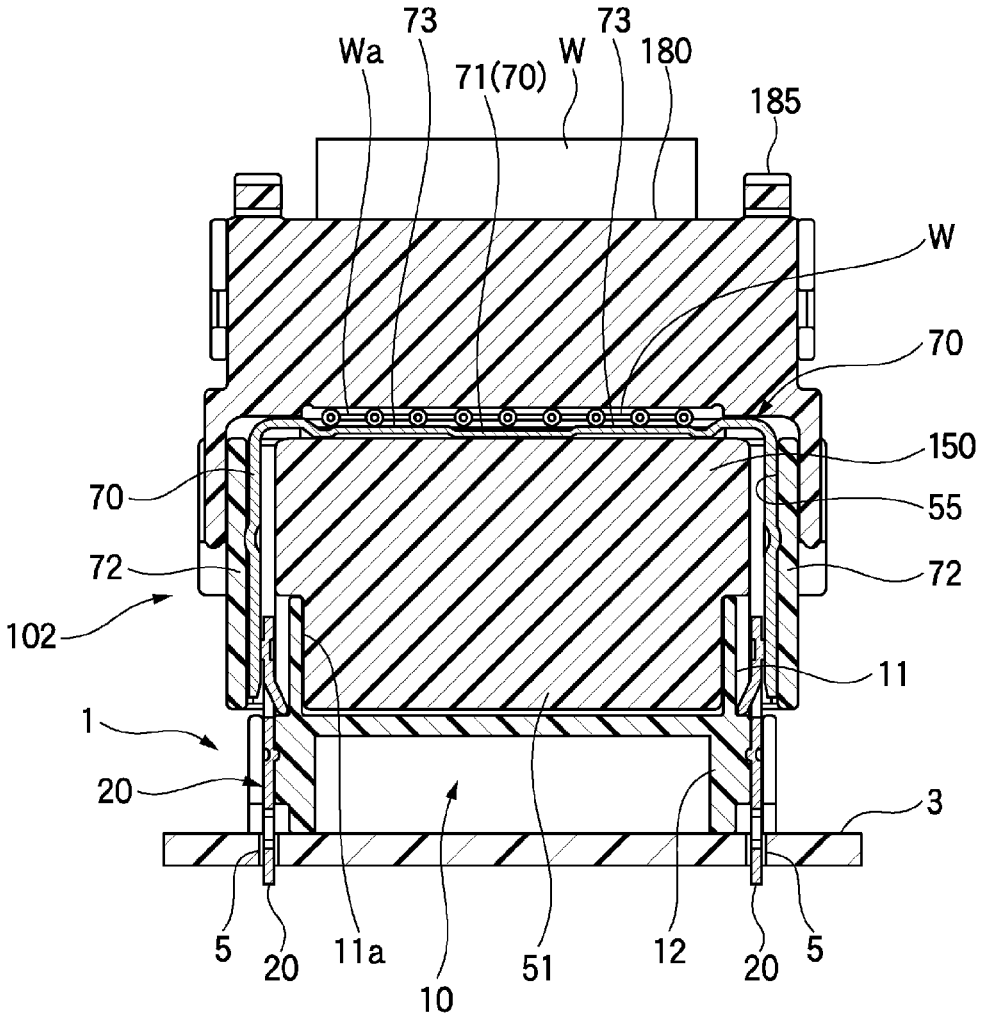
FIG. 17 is a vertical sectional view which shows the state of FIG. 16.

FIGS. 10 to 17 are illustrative figures of the second embodiment. FIG. 10 is an exploded perspective view of a connector device which includes a connector of the second embodiment. FIG. 11 is a perspective view which shows that a bus bar and terminals are assembled to a connector housing of the connector of the second embodiment, when watched from the back side. FIG. 12 is a perspective view of a cover which is a component of the connector. FIGS. 13A to 13C are perspective views which show the constitution of an end processed portion of a shield attached flat cable that is used for the connector, in which FIG. 13A is an appearance view, FIG. 13B is an enlarged view of a part of the end processed portion, and FIG. 13C is a figure watched from above. FIG. 14 is a sectional view which shows that the cover is mounted to the back end surface of the connector housing shown in FIG. 11 and the connector is completed. FIG. 15 is an enlarged view of the XV part of FIG. 14. FIG. 16 is an appearance perspective view which shows that the connector of the second embodiment is connected to a board side connector at a connection mating side. FIG. 17 is a vertical sectional view which shows the state of FIG. 16.

The connector device shown in FIG. 10 includes a board side connector (receptacle) 1 and a cable side connector 102 of the second embodiment which engage with each other. The constitution of the board side connector 1 is similar to that of the first embodiment. The cable side connector 102 of the second embodiment is only different from that of the cable side connector 2 of the first embodiment in the constitutions of a female housing 150 and a cover 180, and the other components are similar to those of the first embodiment. Therefore, those components similar to those of the first embodiment are given the same reference signs, and their description is omitted.

As shown in FIG. 2, the back end surface of the female housing 150 is not provided with the holding salient 59 (refer to FIG. 2). The reason is that it is not the back end surface of the female housing 150 that holds and fixes the electric wire sheath Wc attached part of the shield attached flat cable W. Therefore, the size of the lower half of the female housing 150 is shorter than that of the female housing 50 of the first embodiment. Except this, the female housing 150 is similar to the female housing 50 of the first embodiment.

As shown in FIG. 12, the cover 180 includes a central cover body (first cover body) 181, a pair of right and left side plates 182 which extend forward from the right and left two sides of the central cover body 181 and are inserted into the side plate insertion portions 58 of the female housing 50 when the cover 180 is mounted to the female housing 150, and an auxiliary cover (second cover body) 186 which is connected to the cover body 181 through hinges 185. The cover body 181, the right and left side plates 182, the auxiliary cover 186 and the hinges 185 are integrally molded by resin.

The auxiliary cover 186 is connected to the back portion of the cover body 181 through the hinges 85. After the shield attached flat cable W is press-connected, as shown in FIG. 15, the auxiliary cover 186 is incorporated to the lower portion of the cover body 181 to hold and fix the electric wire sheath Wc attached part of the shield attached flat cable W between the cover body 181 and the auxiliary cover 186. A cable holding portion (cable fixing portion) 190 is constructed by the bottom surface of the cover body 181 and the top surface of the auxiliary cover 186.

Like the first embodiment, the cover body 181 is mounted to the female housing 150 to cover the back end surface of the female housing 150 while the shield attached flat cable W, the press-connecting blades 62 of the female terminals 60 and the bus bar plate 70 are intervened between the back end surface of the female housing 150 and the cover body 181. The pressing force when the cover body 181 is mounted plays a role of making the signal lines Wa1 of the shield attached flat cable W to be press-connected to the press-connecting blades 62 that penetrate the insulators Wa2, and making the shield member Wb that is exposed from the shield attached flat cable W contact the bus bar plate 70.

The pair of right and left side plates 182 are formed with the locking grooves 182*a* into which the locking salients 58*a* of the female housing 150 are locked when the cover body 181 is appropriately mounted to the female housing 150. Further, the right and left side surfaces of the cover body 181 are provided with locking plates 183 which engage with engaging projections 187 of the auxiliary cover 186 when the hinges 185 are bent to make the auxiliary cover 186 incorporated to the bottom surface of the cover body 181.

Next, a way of assembling the board side connector 1 and the cable side connector 2, and a way of using them are described.

To assemble the cable side connector 102, first, the female terminals 60 and the bus bar plate 70 are mounted to the female housing 150.

Next, an end of the shield attached flat cable W is processed as shown in FIGS. 13A to 13C. When the connector of the second embodiment is used, a length of the electric wire sheath Wc, which is longer than that of the first embodiment, is removed so that a suitable length of the shield member Wb is exposed at the removed part. Further, a suitable length of the shield member Wb is removed so that a suitable length of the flat cable body Wa (the part including the signal lines Wa1 and the insulators Wa2) is exposed at the removed part.

Then, the end processed portion of the shield attached flat cable W is arranged to cover the top of the central bar 71 of the bus bar plate 70 which was previously mounted the back portion of the female housing 150, and as shown in FIGS. 14 and 15, from the back side of the end processed portion of the shield attached flat cable W, the cover body 181 is mounted to the back portion of the female housing 150 while a pressing force is applied. The locking salients 58*a* of the female housing 150 are locked into the locking grooves 182*a* of the right and left side plates 182 of the cover body 181.

Then, while the end processed portion of the shield attached flat cable W, the press-connecting blades 62 of the female terminals 60 and the bus bar plate 70 are intervened between the back end surface of the female housing 150 and the cover 80, the back end surface of the female housing 150 is covered by the cover body 181. By a pressing operation when the cover body 181 is mounted, the press-connecting blades 62 of the female terminals 60 cut into the positions of the signal lines Wa1 of the flat cable body Wa where the electric wire sheath Wc and the shield member Wb are removed, and the female terminals 60 and the signal lines Wa1 are press-connected. By mounting the cover body 181, as shown in FIG. 15, the shield member Wb exposed from the shield attached flat cable W is pressed to contact the bus bar plate 70.

Next, the hinges 185 are bent to integrate the auxiliary cover 186 with the cover body 181, and the electric wire sheath Wc attached part of the shield attached flat cable W is sandwiched between the auxiliary cover 186 and the cover body 181. Thereby, a useless external force can be prevented from being exerted to the press-connecting part where the flat cable body Wa and the female terminals 60 are press-connected.

Then, as shown in FIGS. 16 and 17, when the cable side connector 102 constructed in this way is engaged with the board side connector 1, the shield attached flat cable W can be electrically connected to the circuit board 3. In this case, when the side bars 72 of the bus bar plate 70 of the cable side connector 102 slide to electrically contact the outer side surfaces of the base end side of the pegs 20 of the board side connector 1, the shield member Wb of the shield attached flat cable W can be connected to the grounding circuit of the circuit board 3 through the bus bar plate 70 and the pegs 20.

As described above, according to the cable side connector 102 in this connector device, only by performing one operation of mounting the cover body 181 to the female housing 150, the connection of the female terminals 60 and the signal lines Wa1, and the connection of the bus bar plate 70 and the shield member Wb can be collectively performed at the same time. Therefore, the man-hours of the connecting operation of the cable side connector 102 and the shield attached flat cable W can be significantly reduced.

Further, when the cover body 181 is mounted, the shield member Wb contacts the bus bar plate (equivalent to a grounding member) 70 that is mounted to the back end surface of the female housing 150. Thus, it is only required to keep the shield member Wb of the shield attached flat cable W exposed before the cover body 181 is mounted, and the constitution can be simplified.

Because the electric wire sheath Wc attached part of the shield attached flat cable W can be hold and fixed by the cable holding portion that is provided between the cover body 181 and the auxiliary cover 186, a useless external force can be prevented as much as possible from being exerted to the press-connecting part where the flat cable body Wa and the female terminals 60 are press-connected.

In the present embodiment, because the cover body 181 and the auxiliary cover 186 are coupled through the hinges 185, the cover body 181 and the auxiliary cover 186 can be molded as one component, and can be handled as one component.

The present invention is not limited to the above-described embodiments, and suitable modifications, improvements and the like can be made. Moreover, the materials, shapes, dimensions, numbers, installation places, and the like of the components in the above embodiment are arbitrarily set as far as the invention can be attained, and not particularly restricted.

For example, in the description of the first embodiment and the second embodiment, it is indicated that the whole periphery of the electric wire sheath Wc in a predetermined length range is peeled from one end when the end of the shield attached flat cable W is processed, but it is also possible to peel half of the periphery.

Figure 18A:
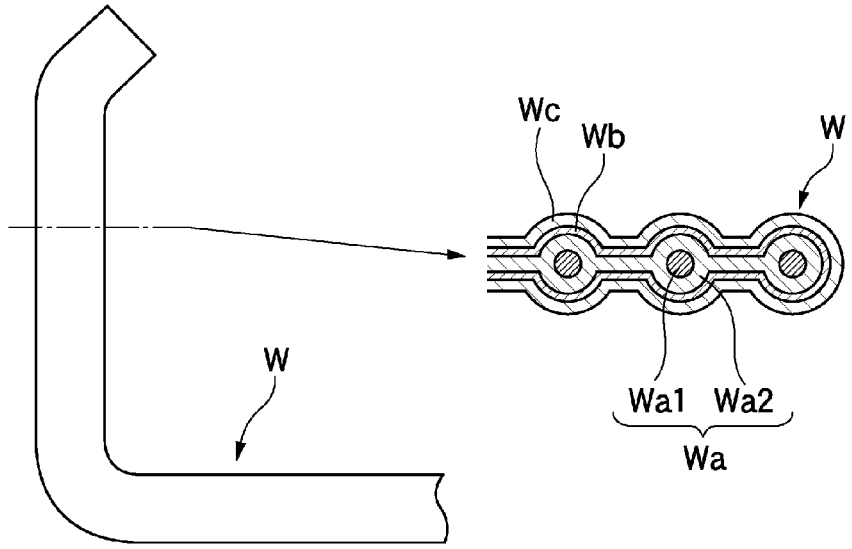
FIGS. 18A and 18B are figures which show another constitution example of the end processed portion of the shield attached flat cable that is used for the connector of the first embodiment or the second embodiment of the present invention, and show that half of the periphery of an electric wire sheath Wc is peeled and the other half body remains, in which FIG. 18A includes a side view and a sectional view before the electric wire sheath Wc is peeled, and FIG. 18B includes a side view and sectional views of after the electric wire sheath Wc is peeled.
Figure 18B:
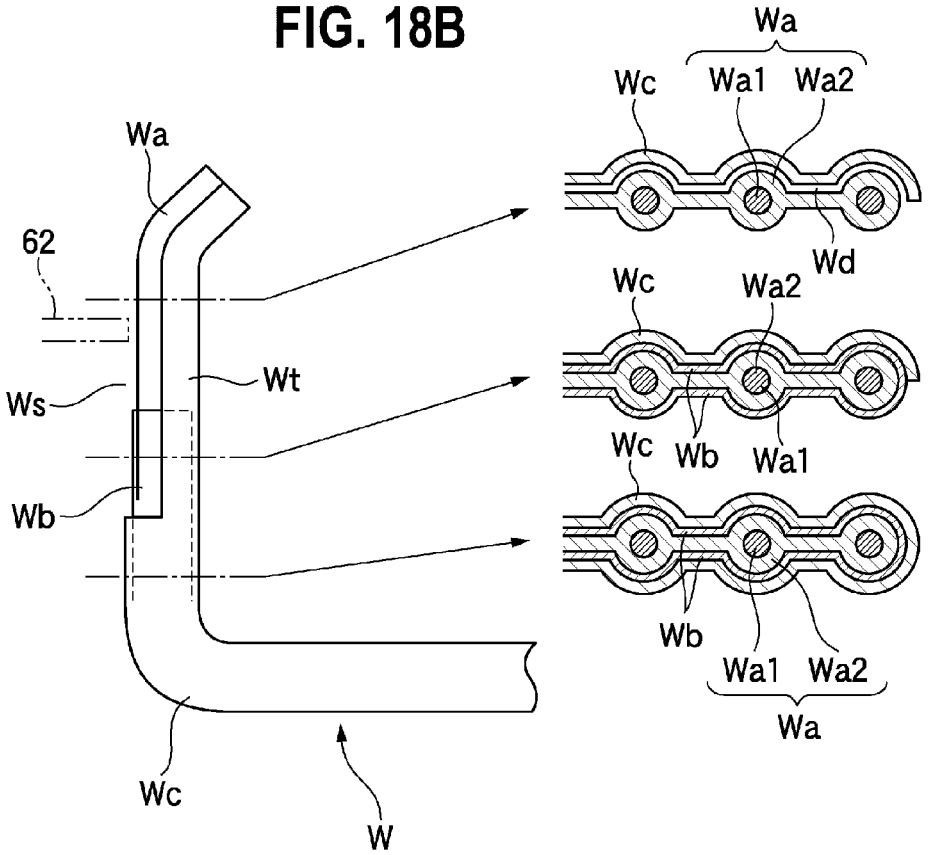

FIGS. 18A and 18B indicates that half of the periphery of the electric wire sheath Wc is peeled and the other half body remains, in which FIG. 18A includes a side view and a sectional view before the electric wire sheath Wc is peeled, and FIG. 18B includes a side view and sectional views of respective parts after the electric wire sheath Wc is peeled.

In this example, only a half body Ws, at the side where the bus bar plate 70 and the shield member Wb contact in the thickness direction of the shield attached flat cable W, of the electric wire sheath Wc of the shield attached flat cable W is removed, and the other half body Wt at the opposite side remains until the positions where the press-connecting blades 62 press-connect. Besides, the shield member Wb at the positions where the press-connecting blades 62 press-connect is removed (this part becomes an empty space Wd) and the shield member Wb is exposed at a part which contacts the bus bar plate 70.

The shield attached flat cable W whose end is processed in this way is put on the back surface of the bus bar plate 70. While the shield attached flat cable W, the press-connecting blades 62 of the female terminals 60 and the bus bar plate 70 are intervened between the back end surfaces of the female housing 50, 150 and the cover body 81, 181, the cover body 81, 181 is mounted to the female housing 50, 150 to cover the back end surface of the female housing 50, 150. At this time, the pressing force when the cover body 81, 181 is mounted makes the press-connecting blades 62 penetrate the insulators Wa2 and the half body Wt of the electric wire sheath Wc of the flat cable body Wa to be press-connected to the signal lines Wa1, and makes the shield member Wb that is exposed from the shield attached flat cable W contacts the bus bar plate 70. Furthermore, in this state, the shield attached flat cable W is held and fixed by the cable fixing portion (the cable holding salients 84 or the cable holding portion 190) which the cover 80, 180 is provided with.

According to the connecting structure of the cable side connector 2, 102 constructed in this way and the shield attached flat cable W, because the half body Wt of the electric wire sheath Wc at the part where the press-connecting blades 62 press-connect the signal lines Wa1 remains, the press-connecting blades 62 penetrate the insulators Wa2 and the half body Wt of the electric wire sheath at the same time, and the combination of the press-connecting blades 62 and the shield attached flat cable W becomes strong.

The features of the embodiments of the connector according to the present invention described above are briefly, collectively listed in the following [1] to [5], respectively.

[1] A connector (cable side connector 2, 102) which is connected to a shield attached flat cable (W) in which the peripheries of signal lines (Wa1) are covered by insulators (Wa2), the outsides of the insulators (Wa2) are covered by a shield member (Wb) and the outside of the shield member (Wb) is covered by an electric wire sheath (Wc), comprising a connector housing (female housing 50, 150), terminals (60) which are accommodated in the connector housing so that press-connecting blades (62) are exposed from the back end surface of the connector housing, a bus bar (bus bar plate 70) which is mounted to the back end surface of the connector housing, and is connected to a grounding circuit, and a cover (180) which, while the shield attached flat cable, the press-connecting blades of the terminals and the bus bar are intervened between the back end surface of the connector housing and the cover, is mounted to the connector housing to cover the back end surface of the connector housing by a pressing force which makes the press-connecting blades that penetrate the insulators to be press-connected to the signal lines of the shield attached flat cable and makes the shield member that is exposed from the shield attached flat cable contact the bus bar, wherein the cover is provided with a cable fixing portion (cable holding salients 84) that holds and fixes the shield attached flat cable.

[2] The connector according to [1], wherein the cover is provided with a cable holding portion (cable holding salients 84), as the cable fixing portion, which holds and fixes an electric wire sheath attached part of the shield attached flat cable between the connector housing and the cover when the cover is mounted to the connector housing.

[3] The connector according to [1], wherein the cover is provided with a cable holding portion (cable holding salients 84), as the cable fixing portion, which makes the shield member which is exposed from the shield attached flat cable press and contact the bus bar, and at the same time holds and fixes the shield attached flat cable between the bus bar and the cover, when the cover is mounted to the connector housing.

[4] The connector according to [1], wherein the cover has a first cover body (cover body 181) which, while the shield attached flat cable, the press-connecting blades of the terminals and the bus bar are intervened between the back end surface of the connector housing and the cover, is mounted to the connector housing to cover the back end surface of the connector housing by a pressing force which makes the press-connecting blades that penetrate the insulators to be press-connected to the signal lines of the shield attached flat cable and makes the shield member that is exposed from the shield attached flat cable contact the bus bar, and a second cover body (auxiliary cover 186) which is mounted to the first cover body, and is provided with a cable holding portion (cable holding salients 84), as the cable fixing portion, between the first cover body and the second cover body, which holds and fixes an electric wire sheath attached part of the shield attached flat cable between the first cover body and the second cover body when the first cover body is mounted to the second cover body.

[5] The connector according to [4], wherein the cover is provided with a hinge portion (185) which couples the first cover body with the second cover body.

Although the present invention is described in detail with reference to the specific embodiments, it is apparent that various modifications and amendments may be made by those skilled in the art without departing from the spirit and scope of the present invention.

This application is based on the Japanese patent application (patent application No. 2013-079792) filed on Apr. 5, 2013, whose content is incorporated herein by reference.

INDUSTRIAL APPLICABILITY

According to the connector of the present invention, only by performing one operation of mounting the cover to the connector housing, the connection of the terminals and the signal lines, and the connection of the bus bar and the shield member can be collectively performed at the same time. The present invention playing this effect is useful in the field of a connector that is connected to a shield attached flat cable.

REFERENCE SIGNS LIST

W shield attached flat cable
Wa1 signal line
Wa2 insulator
Wb shield member
Wc electric wire sheath
Ws removed half body
Wt remaining half body
2, 102 cable side connector (connector)
50, 150 female housing (connector housing)
60 female terminal
62 press-connecting blade
70 bus bar plate (bus bar)
80 cover
84 cable holding salient (cable fixing portion, cable holding portion)
180 cover 181 cover body (first cover body)
185 hinge
186 auxiliary cover (second cover body)
190 cable holding portion

The invention claimed is:

1. A connector for connection to a shield attached flat cable in which peripheries of signal lines are covered by insulators, outsides of the insulators are covered by a shield member and an outside of the shield member is covered by an electric wire sheath, the connector comprising:

a connector housing including a back end surface;

terminals, each including a press-fitting blade, that are accommodated in the connector housing so that the press-connecting blades are exposed from the back end surface of the connector housing;

a bus bar that is mounted to the back end surface of the connector housing, and is configured to be connected to a grounding circuit; and a cover that, while the shield attached flat cable, the press-connecting blades of the terminals and the bus bar are intervened between the back end surface of the connector housing and the cover, is mounted to the connector housing to cover the back end surface of the connector housing by a pressing force which makes the press-connecting blades that penetrate the insulators to be press-connected to the signal lines of the shield attached flat cable and makes the shield member that is exposed from the shield attached flat cable directly contact the bus bar, wherein the cover is provided with a cable fixing portion that directly contacts the electric wire sheath so as to hold and fix the shield attached flat cable when the shield attached flat cable and the cover are mounted to the connector housing.

2. The connector according to claim 1, wherein the cover is provided with a cable holding portion, as the cable fixing portion, which holds and fixes the electric wire sheath of the shield attached flat cable between the connector housing and the cover when the shield attached flat cable and the cover are mounted to the connector housing.

3. The connector according to claim 1, wherein the cover is provided with a cable holding portion, as the cable fixing portion, which makes the shield member which is exposed from the shield attached flat cable press and directly contact the bus bar, and at the same time holds and fixes the shield attached flat cable between the bus bar and the cover, when the shield attached flat cable and the cover are mounted to the connector housing.

4. The connector according to claim 1, wherein the cover has a first cover body which, while the shield attached flat cable, the press-connecting blades of the terminals and the bus bar are intervened between the back end surface of the connector housing and the cover, is mounted to the connector housing to cover the back end surface of the connector housing by a pressing force which makes the press-connecting blades that penetrate the insulators to be press-connected to the signal lines of the shield attached flat cable and makes the shield member that is exposed from the shield attached flat cable contact the bus bar, and a second cover body which is mounted to the first cover body, and is provided with a cable holding portion, as the cable fixing portion, between the first cover body and the second cover body, which holds and fixes an electric wire sheath attached part of the shield attached flat cable between the first cover body and the second cover body when the first cover body is mounted to the second cover body.

5. The connector according to claim 4, wherein the cover is provided with a hinge portion which couples the first cover body with the second cover body.

6. The connector according to claim 1, wherein the cover has an opposing surface that opposes the back end surface of the connector housing when the cover is mounted to the connector housing, and the cable fixing portion includes a convex portion extending along the opposing surface.

7. The connector according to claim 6, wherein the connector housing includes a convex portion extending along the back end surface of the connector housing, and the convex portion of the connector housing opposes the convex portion of the cover when the cover is mounted to the connector housing.

* * * * *